US007147085B2

(12) United States Patent
Sekimoto

(10) Patent No.: US 7,147,085 B2
(45) Date of Patent: Dec. 12, 2006

(54) DISPLAY SYSTEM FOR ELEVATOR AND INFORMATION DISPLAY DEVICE USED IN THIS SYSTEM

(75) Inventor: Yoichi Sekimoto, Fuchu (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/415,184

(22) Filed: May 2, 2006

(65) Prior Publication Data

US 2006/0191750 A1 Aug. 31, 2006

Related U.S. Application Data

(63) Continuation of application No. PCT/JP04/17008, filed on Nov. 16, 2004.

(30) Foreign Application Priority Data

Nov. 18, 2003 (JP) ..... 2003-388101

(51) Int. Cl.
*B66B 3/02* (2006.01)

(52) U.S. Cl. ..... 187/399; 187/394

(58) Field of Classification Search ..... 187/391–397, 187/247, 399; 345/649, 654
See application file for complete search history.

(56) References Cited

U.S. PATENT DOCUMENTS

| | | | | |
|---|---|---|---|---|
| 5,398,783 | A * | 3/1995 | Jacoby | 187/395 |
| 6,161,656 | A * | 12/2000 | Horbrugger et al. | 187/394 |
| 6,550,587 | B1 * | 4/2003 | Yuasa et al. | 187/394 |
| 7,040,459 | B1 * | 5/2006 | Matsuda et al. | 187/399 |

FOREIGN PATENT DOCUMENTS

| | | | |
|---|---|---|---|
| JP | 3-267280 | A | 11/1991 |
| JP | 6-247654 | A | 9/1994 |
| JP | 7-215614 | A | 8/1995 |
| JP | 11-209013 | A | 8/1999 |
| JP | 2001-310882 | A | 11/2001 |

* cited by examiner

*Primary Examiner*—Jonathan Salata
(74) *Attorney, Agent, or Firm*—Foley & Lardner LLP

(57) ABSTRACT

There is provided a display system for an elevator which can display an operating state of an elevator car without a sense of discomfort even though data transmission performance is not improved. Data concerning an operating state of an elevator car is transmitted from an elevator control device to an information display device set in the elevator car or the like through a transmission cable. At this time, the information display device side infers the next data which should be displayed in synchronization with an operation of the elevator car. As a result, even if data transfer from the elevator control device is delayed at the time of a high-speed operation, the inferred data can be used to display an operating state of the elevator car without a sense of discomfort.

16 Claims, 6 Drawing Sheets

65

| Floor height | Floor height information |
|---|---|
| 1F-2F | a m |
| 2F-3F | b m |
| 3F-4F | c m |
| ⋮ | ⋮ |

DISPLAY SYSTEM FOR ELEVATOR AND INFORMATION DISPLAY DEVICE USED IN THIS SYSTEM

CROSS-REFERENCE TO RELATED APPLICATIONS

This is a Continuation Application of PCT Application No. PCT/JP04/017008, filed Nov. 16, 2004, which was published under PCT Article 21(2) in Japanese.

This application is based upon and claims the benefit of priority from prior Japanese Patent Application No. 2003-388101, filed Nov. 18, 2003, the entire contents of which are incorporated herein by reference.

BACKGROUND OF THE INVENTION

1. Field of the Invention

The present invention relates to a display system for an elevator which is preferable to be used when displaying an operating state of an elevator car at a predetermined position in, e.g., an ultrahigh-speed elevator, and an information display device used in this system.

2. Description of the Related Art

In an elevator, an operating state of an elevator car is constantly monitored by an elevator control device which is called a "control board". Data concerning an operating state of this elevator car is transferred to an information display device or the like in the elevator car through a transmission cable.

Here, in a regular elevator, data concerning an operating state of an elevator car is periodically transferred from an elevator control device in accordance with a timing at which the elevator car moves to each floor. Therefore, on the information display device side, an operating state of the elevator car can be displayed in real time based on these data.

Meanwhile, in a superultrahigh-speed elevator whose rated speed (a maximum speed) exceeds, e.g., 1000 m/min, an elevator car moves between respective floors at a very high speed. Therefore, data transfer from an elevator control device to the elevator car is unable to follow a speed of the elevator car, and there occurs a problem that a position of the elevator car is intermittently displayed like "50th floor"→"52th floor"→"54th floor" . . . , for example.

There has been conventionally known, e.g., Jpn. Pat. Appln. KOKAI Publication No. 1994-247654 which eliminates a delay of a display timing due to an increase in speed of such an elevator. In this publication, when an elevator car has passed through an intermediate position between floors, a display switching signal is generated from an elevator control device side, thereby directing an information display device to switch display in accordance with each floor ahead of time.

However, a method of adjusting a timing on the elevator control device side has a limit. Therefore, the elevator car may possibly pass through a floor as a display target before display is switched on the information display device side upon receiving the display switching signal.

As described above, when an elevator car travels at high speed, there is a problem that data transferred from an elevator control device to the elevator car is delayed so that a position or the like of the elevator car is intermittently displayed. In this case, the above-described problem can be eliminated by, e.g., increasing data transfer performance of the elevator control device. However, there is a demerit that a cost involved by an improvement in performance is required and an existing control device cannot be used.

BRIEF SUMMARY OF THE INVENTION

In view of the above-described points, it is an object of the present invention to provide a display system for an elevator which can constantly display an operating state of an elevator car without a sense of discomfort even though data transfer performance is not improved, and an information display device used in this system.

According to an aspect of the invention, there is provided a display system for an elevator comprising: a control device which controls an operation of an elevator car; and an information display device which is connected with the control device through a transmission cable to display an operating state of the elevator car at a predetermined position, wherein the control device comprises:

an operating state detecting unit which detects an operating state of the elevator car; and a data transferring unit which transfers data concerning an operating state of the elevator car detected by the operating state detecting unit with an operation of the elevator car to the information display device through the transmission cable, and the information display device comprises:

a data receiving unit which receives data transferred from the control device;

a display inferring unit which infers the next data which should be displayed in synchronization with an operation of the elevator car; and a display controlling unit which displays an operating state of the elevator car based on data received by the data receiving unit or data inferred by the display inferring unit.

DETAILED DESCRIPTION OF THE INVENTION

An embodiment according to the present invention will now be described hereinafter with reference to the accompanying drawings.

Figure 1:
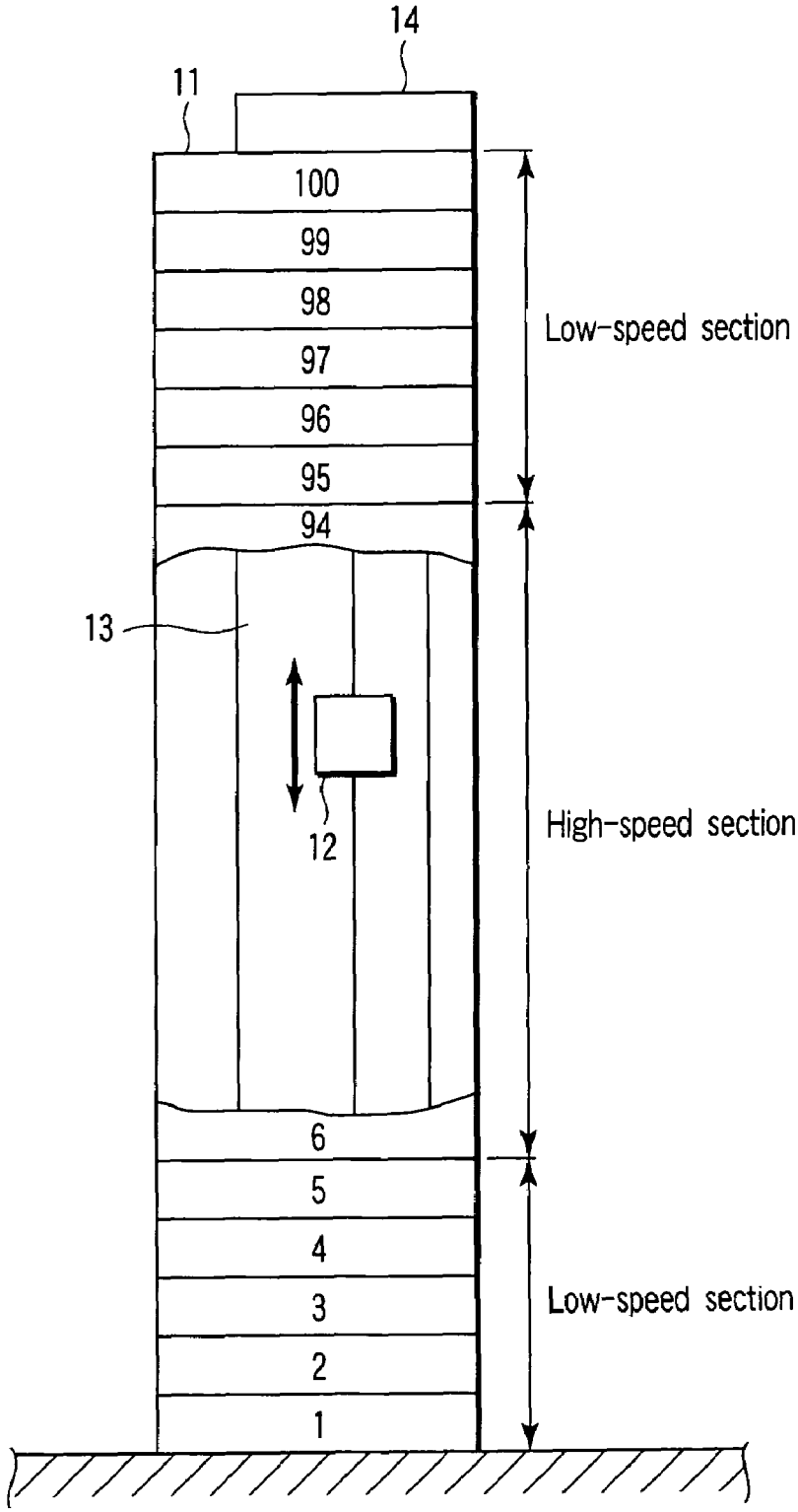
FIG. 1 is a view showing an example of a skyscraper to which an elevator according to an embodiment of the present invention is applied.

FIG. 1 is a view showing an example of a skyscraper to which an elevator according to an embodiment of the present invention is applied. In the example of FIG. 1, there is shown a skyscraper 11 having a plurality of floors from a 1st floor to a 100th floor. In the drawing, reference numeral 12 denotes an elevator car set in this skyscraper 11.

The elevator car 12 moves up and down in a hoistway 13 to bring a passenger to a target floor. In this case, for example, a floor from which the elevator car 12 starts traveling is the 1st floor in such a skyscraper 11 as shown in FIG. 1, and a high-speed operation is performed skipping intermediate floors in order to rapidly bring a passenger to the 100th floor. In such a case, a 6th floor to a 94th floor correspond to a high-speed section, and other floors, i.e., the 1st floor to a 5th floor and a 95th floor to the 100th floor correspond to a low-speed section.

It is to be noted that the high-speed section and the low-speed section vary depending on a floor from which the elevator car 12 starts traveling.

In the high-speed section from the 6th floor to the 94th floor, the elevator car 12 rapidly travels at a rated speed (a maximum speed) between the 5th floor and the 94th floor without stopping at the respective floors except the 6th floor and the 94th floor. The rated speed is, e.g., 1000 m/min. On the other hand, in the low-speed section from the 1st floor to the 5th floor and from the 95th floor to the 100th floor, the elevator car 12 stops at each floor.

Figure 2:
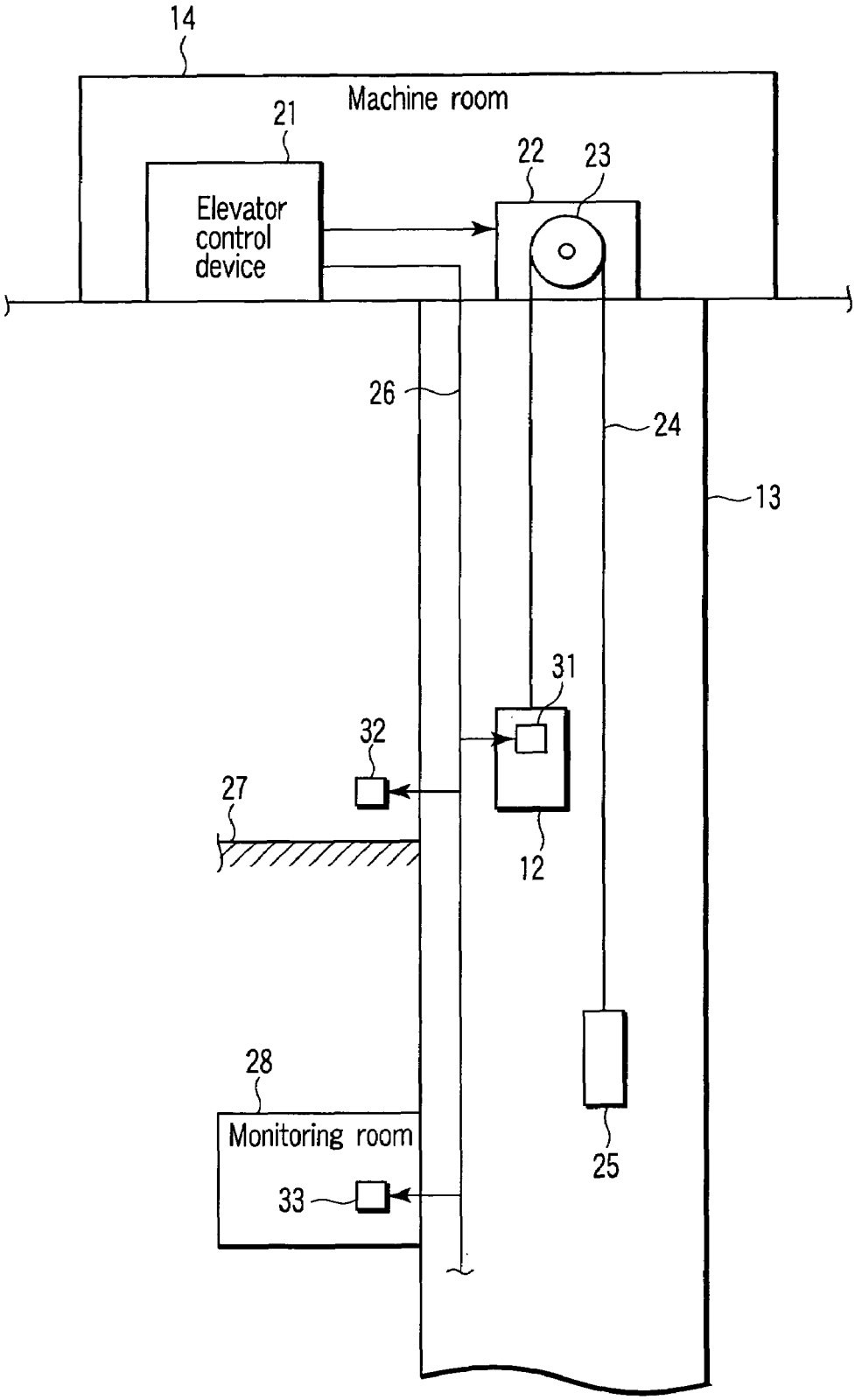
FIG. 2 is a view showing a schematic structure of the elevator in the embodiment.

Further, reference numeral 14 in the drawing designates a machine room, and a control device, a driving mechanism and others of the elevator are set in this machine room 14 (see FIG. 2).

FIG. 2 is a view showing a schematic configuration of the elevator. In FIG. 2, like reference numerals denote parts equal to those in FIG. 1.

An elevator control device (a control board) 21, a traction machine 22, sheave 23 and others are set in the machine room 14 provided at the uppermost portion of the skyscraper 11. The elevator control device 21 controls an operation of the elevator car 12 and is constituted of a general-purpose computer. The traction machine 22 is driven by a driving control signal output from the elevator control device 21. The sheave 23 rotates by driving of this traction machine 22, and the elevator car 12 moves up and down together with a counterweight (a counter weight) 25 in the hoistway 13 in a pickup and supply mode through a main rope 24 wound around this sheave 23.

Here, an information display device 31 is set in the elevator car 12. This information display device 31 displays an operating state such as an operating speed or a position of the elevator car 12. Further, the same information display devices 32 and 33 are set in an elevator hall 27 on each floor and an elevator monitoring room 28 where a monitoring personnel stands by. These information display devices 21, 32 and 33 are connected with the elevator control device 21 through a transmission cable 26.

The elevator control device 21 detects an operating state of the elevator car 12, and transfers data of the detected state to the information display devices 31, 32 and 33 through the transmission cable 26 in real time. Upon receiving data transferred from the elevator control device 21, each of the information display devices 21, 32 and 33 displays an operating speed or a position of the elevator car 12 included in this data in a predetermined format in a screen.

Furthermore, each of the information display devices 31, 32 and 33 is provided with a function of inferring the next data to be displayed and displaying the inferred data when transfer of information from the elevator control device 21 is delayed at the time of, e.g., a high-speed operation.

Of the respective information display devices 31, 32 and 33, the information display device 31 provided in the elevator car 12 will be described hereinafter, but the other information display devices 32 and 33 are the same as the information display device 31.

Figure 3:
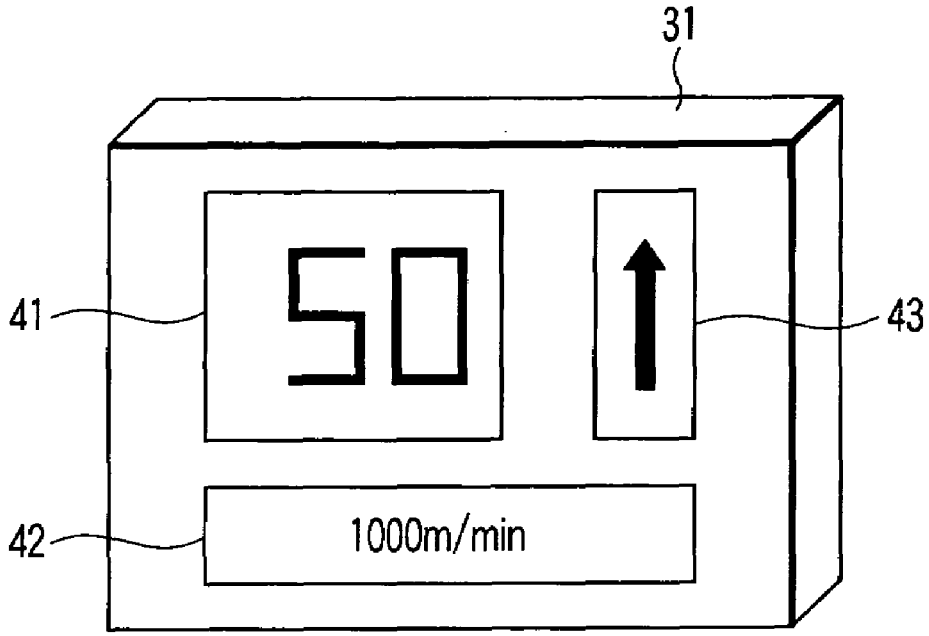
FIG. 3 is a view showing an example of a screen configuration of an information display device provided in an elevator car of the elevator in the embodiment.

FIG. 3 is a view showing an example of a screen configuration of the information display device 31 provided in the elevator car 12 of the elevator.

The information display device 31 is set at a position which can be readily seen from a passenger, e.g., in the vicinity of an upper part of a door. Display units 41 to 43 each consisting of, e.g., a liquid crystal display (LCD) are provided on a device main body of this information display device 31. The display unit 41 displays a current position (a floor number) of the elevator car 12. The display unit 42 displays a current operating speed of the elevator car 12. The display unit 43 displays a traveling direction of the elevator car 12.

It is to be noted that a shape or a screen configuration of this information display device 31 is not restricted to the example shown in FIG. 3 in particular, and any other structure may be adopted. Furthermore, an operating speed, a position and a traveling direction of the elevator car 12 are displayed in this example, but other information, e.g., a message indicating occurrence of a defect may be also displayed.

Figure 4:
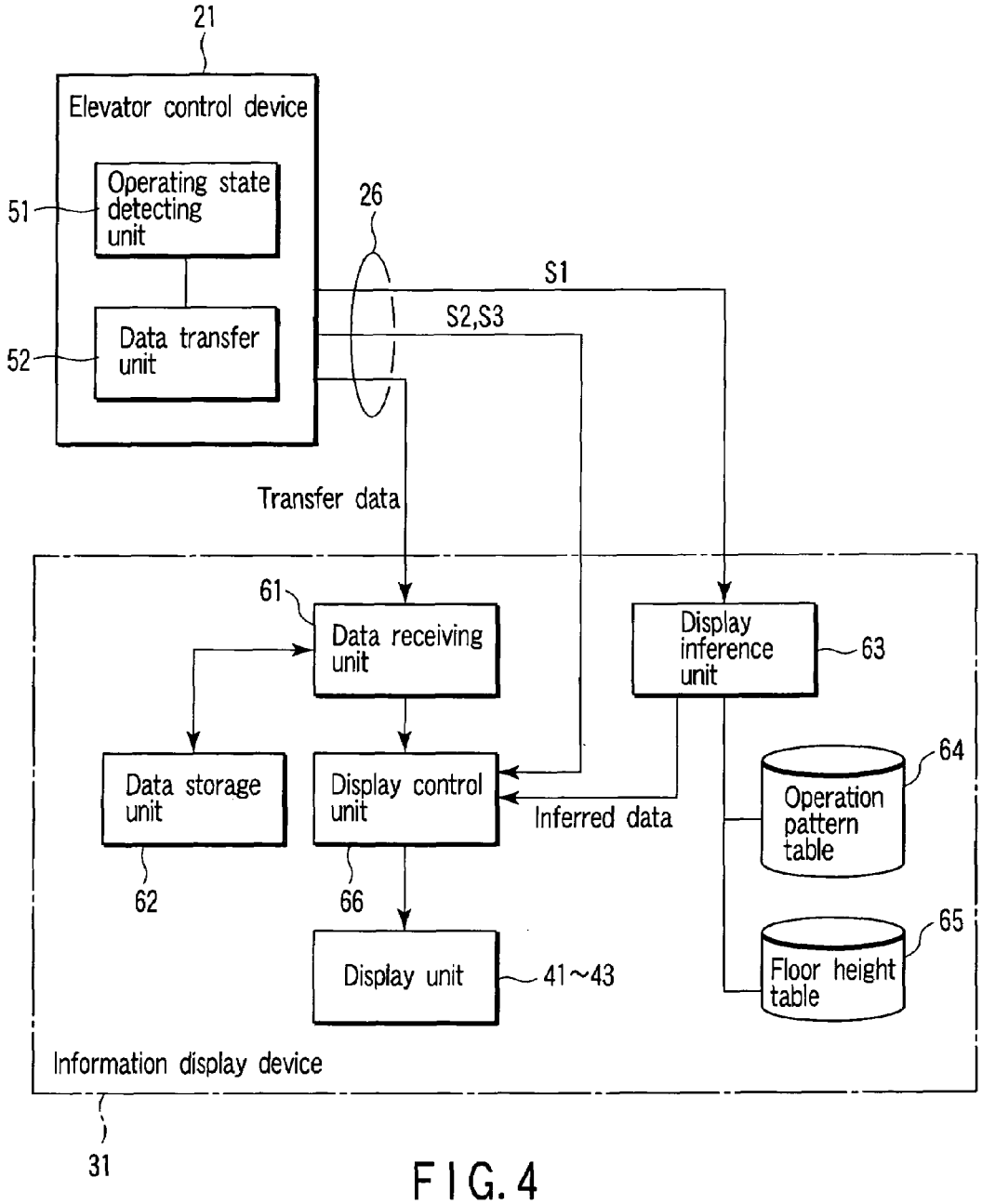
FIG. 4 is a block diagram showing a configuration of an elevator display system constituted of an elevator control device and the information display device in the embodiment.

FIG. 4 is a block diagram showing a configuration of an elevator display system constituted of the elevator control device 21 and the information display device 31.

The elevator control device 21 is provided with an operating state detecting unit 51, a data transfer unit 52 and others. The operating state detecting unit 51 detects a current operating state including an operating speed, a position or the like of the elevator car 12. It is to be noted that the operating speed of the elevator car 12 is obtained from, e.g., a revolving speed of the traction machine 22 shown in FIG. 1. Moreover, the position of the elevator car 12 is obtained by, e.g., counting a pulse number output from a non-illustrated pulse encoder provided at a rotary shaft or the like of the traction machine 22.

The data transfer unit 52 performs processing of transferring data concerning an operating state of the elevator car 12 detected by the operating state detecting unit 51 to the information display device 31 through the transfer cable 26.

Additionally, this elevator control device 21 is provided with a function of outputting an operation timing signal S1 indicative of timings of start of operation and deceleration of the elevator car 12, a function of outputting a high-speed traveling signal S2 indicating that the elevator car 12 is traveling at a predetermined speed or a higher speed, a function of outputting a transmission defect signal S3 indicating that a problem has occurred in a transmission system, and others. These signals S1 to S3 are respectively supplied to the information display device 31 through the transmission cable 26.

On the other hand, the information display device 31 is provided with a data receiving unit 61, a data storage unit 62, a display inference unit 63, an operation pattern table 64, a floor height table 65, a display control unit 66 and the display units 41 to 43.

The data receiving unit 61 receives operating state data of the elevator car 12 transmitted from the elevator control device 21. The data storage unit 62 stores data received by the data receiving unit 61. This data storage unit 62 is particularly provided to prevent data from the elevator control device 21 from being output as in-car display data when, e.g., a temporary transmission defect has occurred.

Figures 5, 6:
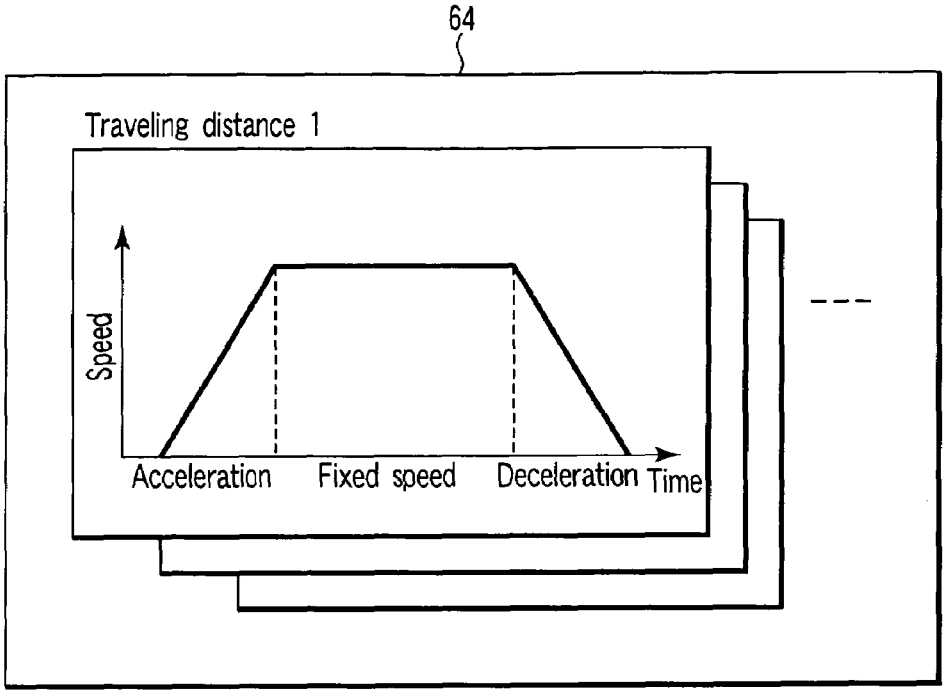
FIG. 5 is a view showing a configuration of an operation pattern table provided in the information display device in the embodiment.
FIG. 6 is a view showing a configuration of a floor height table provided in the information display device in the embodiment.

The display inference unit 63 performs processing of inferring the next data which should be displayed in synchronization with an operation of the elevator car 12. As shown in FIG. 5, the operation pattern table 64 is a table storing a plurality of operation patterns created in accordance with each traveling distance of the elevator car 12 in advance. Further, as shown in FIG. 6, the floor height table 65 is a table storing floor height information between respective floors of the building 11.

The display control unit 66 carries out processing of supplying data transferred from the elevator control device 21 or data inferred by the display inference unit 63 as in-car display data to the display units 41 to 43.

As shown in FIG. 3, the display units 41 to 43 display a position, an operating speed, a traveling direction or the like of the elevator car 12 at a predetermined position in the elevator car 12 based on data selected by the display control unit 66.

An operation of the display system according to the present invention will now be described.

As shown in FIG. 1, when the elevator car 12 is operating at high speed between the 6th floor and the 94th floor of the building 11, transfer of data from the elevator control device 21 is delayed. Therefore, there is a problem that a timing at which the elevator car 12 passes each floor is missed and a position (a floor number) or the like of the elevator car 12 is intermittently displayed, for example.

Thus, in order to eliminate such a problem, the display system according to the present invention is characterized in that the next data which should be displayed is inferred on the information display device 31 side and this inferred data is used to display an operating state of the elevator car 12.

Inference of data is performed by generating operation patterns of the elevator car 12. As a generation method of the operation patterns, there are the following two methods.

(a) A method of generating an operation pattern according to actual traveling of the elevator car 12.

(b) A method of inputting a signal of each point, e.g., acceleration or deceleration and generating a simple operation pattern connecting these points.

A description will be given on the assumption that an operation pattern is generated by the method (a).

At the time of an operation of the elevator car 12, an operation timing signal S1 indicative of timings of start of an operation and deceleration of the elevator car 12 is output to the information display device 31 from the elevator control device 21. This operation timing signal S1 is input to the display inference unit 63 provided in the information display device 31. The display inference unit 63 receives this operation timing signal S1 to generate an operation pattern 71 from start of an operation to arrival to a target floor by the elevator car 12 in accordance with a predetermined operational expression.

Figure 7:
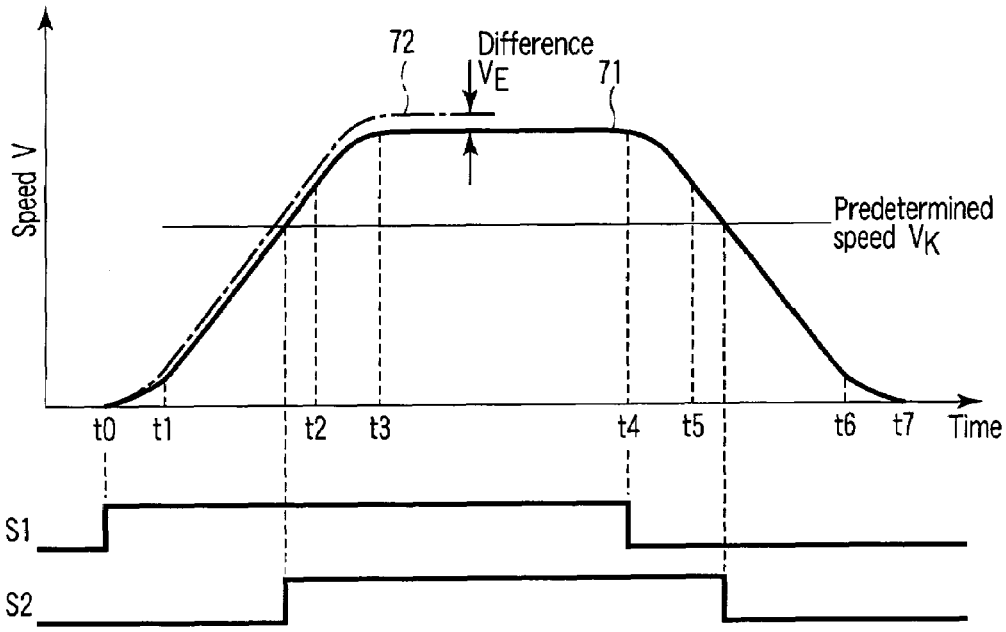
FIG. 7 is a view schematically showing an example of an operation pattern generated by a display inference unit provided in the information display device in the embodiment.

FIG. 7 is a view schematically showing an example of the operation pattern generated by the display inference unit 63. Reference numeral 71 in the drawing denotes the operation pattern, and 72 designates data transferred from the elevator control device 21 (speed data).

This operation pattern 71 includes an acceleration jerk period (t0–t1), an acceleration period (t1–t2), a fixed-speed jerk period (t2–t3), a fixed-speed period (t3–t4), a deceleration jerk period (t4–t5), a deceleration period (t5–t6) and a stop jerk period (t6–t7).

It is to be noted that the "jerk" means a preliminary operation. In particular, the jerk performed before acceleration is referred to as an "acceleration jerk"; the jerk performed before a fixed speed, a "fixed-speed jerk"; the jerk performed before deceleration, a "deceleration jerk"; and the jerk performed before stopping the operation, a "stop/fixed-speed jerk". The unit is "$m/s^2$".

Here, inferred data concerning an operating speed can be obtained in accordance with an operation expression of the operation pattern 71 as follows.

(1) First, in the acceleration jerk period (t0–t1), the elevator car 12 moves with a fixed jerk J. Therefore, a speed V at this time can be obtained by the following expression:

$$V=(1/2)\cdot J\cdot t^2$$

t: a time (2) Then, in the acceleration period (t1–t2) after end of the jerk, the elevator car 12 moves with a fixed acceleration α. Therefore, a speed V at this time can be obtained by the following expression:

$$V=\alpha t+V1$$

V1: a jerk start speed (3) Subsequently, in the fixed-speed jerk period (t2–t3), the elevator car 12 moves with the fixed jerk J. Therefore, a speed V at this time can be obtained by the following expression.

$$V=VR-(1/2)\cdot J\cdot(t3-t2-t)^2$$

VR: a rated speed (4) Then, in the fixed-speed period (t3–t4), the elevator car 12 moves at the rated speed VR. Therefore, a speed V at this time can be obtained by the following expression.

$$V=VR.$$

(5) Subsequently, in the deceleration jerk period (t4–t5), the elevator car 12 moves with the fixed jerk J. Therefore, a speed V at this time can be obtained by the following expression.

$$V=VR-(1/2)\cdot J\cdot t^2$$

(6) Then, in the deceleration period (t5–t6), the elevator car 12 moves with a fixed deceleration β. Therefore, a speed V at this time can be obtained by the following expression.

$$V=V2-\beta t$$

V2: a deceleration jerk end speed (7) Subsequently, in the stop jerk period (t6–t7), the elevator car 12 moves with the fixed jerk J. Therefore, a speed V at this time can be obtained by the following expression.

$$V=V3-(1/2)\cdot J\cdot t^2$$

V3: a stop jerk start speed

It is possible to infer a speed at which the elevator car 12 is traveling at each point in time by making reference to the operation pattern 71 in this manner. Further, integrating the speed at each point in time and multiplying this value can obtain a total traveling distance from a start point. Comparing this total traveling distance with floor height information between respective floors stored in the floor height table 65 can obtain a position (a floor number) of the elevator car 12.

Data of the thus inferred speed or position is supplied to the display control unit 66. In the display control unit 66, consistency or the like of data received by the data receiving unit 61, i.e., transferred data from the elevator control device 21 with respect to inferred data obtained by the display inference unit 63 is judged, and then the transferred data or the inferred data is selectively used to display an operating state of the elevator car 12.

Specifically, as shown in, e.g., FIG. 1, when a traveling distance of one movement of the elevator car 12 is long, i.e., when the elevator car 12 is traveling in the high-speed section (the 6th floor to the 94th floor) at the rated speed, the display inference unit 63 is enabled, and data inferred by this display inference unit 63 is used to display an operating state of the elevator car 12. As a result, even if data transferred from the elevator control device 21 is delayed, the inferred data can be used to display an operating state without a sense of discomfort.

On the other hand, when a traveling distance of one movement of the elevator car 12 is short, i.e., when the elevator car 12 travels in the low-speed section (the 1st floor to the 5th floor, the 95th floor to the 100th floor), data transfer is not delayed. Therefore, transferred data received by the data receiving unit 61 is used to display an operating state of the elevator car 12. A section in which the elevator car 12 is currently traveling is informed to the information display device 31 from the elevator control device 21 during the operation of the elevator car 12. The display control unit 66 in the information display device 31 switches transferred data or inferred data in accordance with the informed traveling section.

Furthermore, besides such a switching method based on a traveling section, as shown in FIG. 7, inferred data may be used only when the elevator car 12 is traveling at a predetermined speed Vk or a higher speed.

The predetermined speed Vk is a speed at which data transfer from the elevator control device 21 may be possibly delayed, and has a value close to the rated speed (the maximum speed) during the high-speed operation. When the elevator car 12 is traveling at the predetermined speed Vk or a higher speed, a high-speed traveling signal S2 is output to the information display device 31 from the elevator control device 21. In the display control unit 66 in the information display device 31, transferred data or inferred data is switched by using this high-speed traveling signal S2.

Moreover, in the display control unit 66, a difference Ve between inferred data and transferred data is obtained. When a value of this difference Ve is not smaller than a predetermined value, the display control unit 66 determines that the display inference unit 63 has a defect, inhibits use of inferred data at this moment, and performs display by using transferred data only. As a result, it is possible to avoid performing erroneous display using inferred data at the time of occurrence of a defect. In this case, since transferred data is used, a position or the like of the elevator car 12 is intermittently displayed, which is better than performing erroneous display to confuse passengers.

Additionally, when data transfer by the elevator control device 21 has a problem, e.g., when the data transmission system goes down due to any factor, a transmission defect signal S3 is transmitted to the information display device 31 from the elevator control device 21.

Upon receiving this transmission defect signal S3, the display control unit 66 inhibits use of transferred data until a transmission defect is eliminated, and performs display by using inferred data only. As a result, it is possible to eliminate an inconvenience that display is stopped in the elevator car 12 at the time of occurrence of a defect.

It is to be noted that the description has been given as to the example where the operation pattern is generated in accordance with the predetermined operational expression during the operation of the elevator car 12 in the foregoing embodiment but, as shown in, e.g., FIG. 5, the operation pattern table 64 storing a plurality of operation patterns created in accordance with respective traveling distances may be used, and an operation pattern corresponding to a traveling distance of the elevator car 12 may be selectively read from this operation pattern table 64, thereby performing the above-described inference processing of data.

Further, although the description has been given as to the example of the information display device 31 provided in the elevator car 12 in the foregoing embodiment, the same technique can be applied to, e.g., the information display device 32 provided in the elevator hall 27 on each floor or the information display apparatus 33 provided in the elevator monitoring room 28 as shown in FIG. 2, and an operating state of the elevator car 12 can be displayed at these positions without a sense of discomfort.

Furthermore, the elevator has a special operation mode such as a "rescue operation" or a "control operation" in addition to a regular operation mode. In the special operation mode, the elevator car 12 travels at a lower speed than that in the regular operation mode. Thus, the display control unit 66 may switch transferred data and inferred data in accordance with the regular operation mode and the special operation mode. In this case, an operating state of the elevator car 12 is displayed by using inferred data in the regular operation mode and by using transferred data in the special operation mode.

Moreover, further features and modifications will be conceived by persons skilled in this technical field. Therefore, the present invention is based on a wider viewpoint, and it is not restricted to specific particulars and a typical embodiment disclosed herein.

Therefore, various modifications can be carried out without departing from an extensive concept of the invention defined in attached claims and interpretation and a scope of equivalents.

According to the present invention, providing the information display device side with the function of inferring the next data which should be displayed in synchronization with an operation of the elevator car enables display of an operating state of the elevator car by using the inferred data without a sense of discomfort when high-speed data transfer is delayed due to a high-speed operation or the like.

What is claimed is:

1. A display system for an elevator comprising: a control device which controls an operation of an elevator car; and an information display device which is connected with the control device through a transmission cable to display an operating state of the elevator car at a predetermined position, wherein the control device comprises:

an operating state detecting unit which detects an operating state of the elevator car; and a data transferring unit which transfers data concerning an operating state of the elevator car detected by the operating state detecting unit with an operation of the elevator car to the information display device through the transmission cable, and the information display device comprises:

a data receiving unit which receives data transferred from the control device;

a display inferring unit which infers the next data which should be displayed in synchronization with an operation of the elevator car; and a display controlling unit which displays an operating state of the elevator car based on data received by the data receiving unit or data inferred by the display inferring unit.

2. The display system for an elevator according to claim 1, wherein the data concerning an operating state of the elevator car includes an operating speed and a position of the elevator car.

3. The display system for an elevator according to claim 1, wherein the display inferring unit generates an operation pattern of the elevator car in accordance with a predetermined operational expression at the time of start of an operation of the elevator car, and performs data inference processing using the operation pattern.

4. The display system for an elevator according to claim 1, wherein the display inferring unit has a table memory storing a plurality of operation patterns created in accordance with respective traveling distances in advance, reads an operation pattern corresponding to a traveling distance of the elevator car from the table memory, and performs data inference processing using the operation pattern.

5. The display system for an elevator according to claim 1, wherein the display controlling unit uses data inferred by the display inferring unit to perform display processing when the elevator car is traveling in a section where high-speed traveling is possible.

6. The display system for an elevator according to claim 1, wherein the display controlling unit uses data inferred by the display inferring unit to perform display processing when the elevator car is traveling at a predetermined speed or a higher speed.

7. The display system for an elevator according to claim 1, wherein the display judging unit obtains a difference between data received by the receiving unit and data inferred by the display inferring unit, inhibits use of the inferred data when the difference is not smaller than a predetermined value, and performs display processing using the data received by the receiving unit.

8. The display system for an elevator according to claim 1, wherein the display judging unit inhibits use of data received by the receiving unit and performs display processing using the data inferred by the display inferring unit when a transmission defect occurs.

9. An information display device which is connected with a control device which controls an operation of an elevator car through a transmission cable to display an operating state of the elevator car at a predetermined position, comprising:

a data receiving unit which receives data concerning an operating state of the elevator car from the control device through the transmission cable;

a display inferring unit which infers the next data which should be displayed in synchronization with an operation of the elevator car; and a display controlling unit which displays an operating state of the elevator car based on data received by the data receiving unit or data inferred by the display inferring unit.

10. The information display device according to claim 9, wherein the data concerning an operating state of the elevator car includes an operating speed and a position of the elevator car.

11. The information display device according to claim 9, wherein the display inferring unit generates an operation pattern in accordance with a predetermined operational expression at the time of start of an operation of the elevator car, and performs data inference processing using the operation pattern.

12. The information display device according to claim 9, wherein the display inferring unit has a table storing a plurality of operation patterns created in accordance with respective traveling distances in advance, reads an operation pattern corresponding to a traveling distance of the elevator car from the table memory, and performs data inference processing using the operation pattern.

13. The information display device according to claim 9, wherein the display controlling unit uses data inferred by the display inferring unit to perform display processing when the elevator car is traveling in a section where high-speed traveling is possible.

14. The information display device according to claim 9, wherein the display controlling unit uses data inferred by the display inferring unit to perform display processing when the elevator car is traveling at a predetermined speed or a higher speed.

15. The information display device according to claim 9, wherein the display judging unit obtains a difference between data received by the receiving unit and data inferred by the display inferring unit, inhibits use of the inferred data when the difference is not smaller than a predetermined value, and performs display processing using the data received by the receiving unit.

16. The information display device according to claim 9, wherein the display judging unit inhibits use of data received by the receiving unit and performs display processing using data inferred by the display inferring unit when a transmission defect occurs.

* * * * *